United States Patent [19]

Killy

[11] 4,331,289

[45] May 25, 1982

[54] FOUR-PLY HANDLED CARTON

[75] Inventor: Earl J. Killy, Monroe, La.

[73] Assignee: Manville Service Corporation, Denver, Colo.

[21] Appl. No.: 262,885

[22] Filed: May 13, 1981

[51] Int. Cl.[3] ..... B65D 5/46

[52] U.S. Cl. ..... 229/52 B; 229/37 R; 229/52 BC; 206/141; 206/427

[58] Field of Search ..... 229/37 R, 52 B, 52 BC, 229/DIG. 6, 17 B; 206/427, 141, 161, 162, 172

[56] References Cited

U.S. PATENT DOCUMENTS

| | | | |
|---|---|---|---|
| 2,615,750 | 10/1952 | O'Sullivan | 294/87.28 |
| 2,616,611 | 11/1952 | Arneson | 229/28 |
| 2,773,625 | 12/1956 | Arneson | 206/172 X |
| 2,785,847 | 3/1957 | Forrer | 229/52 |
| 2,838,223 | 6/1958 | Graf | 229/52 |
| 2,911,136 | 11/1959 | Stone | 229/52 |
| 2,981,459 | 4/1961 | Johnson et al. | 229/52 |
| 3,073,644 | 1/1963 | Baker et al. | 294/87.2 |
| 3,119,544 | 1/1964 | Cope et al. | 229/14 |
| 3,356,279 | 12/1967 | Root | 229/17 |
| 3,515,331 | 6/1970 | Guthrie, Sr. | 229/14 |
| 3,540,581 | 11/1970 | Koolnis | 229/52 |
| 3,722,737 | 3/1973 | Hughes et al. | 229/52 BC |
| 3,812,958 | 5/1974 | Samsing | 206/45.31 |
| 3,894,681 | 7/1975 | Arneson et al. | 229/17 B |
| 3,933,303 | 1/1976 | Kirby, Jr. | 229/52 B |
| 3,994,432 | 11/1976 | Kirby, Jr. | 229/52 B |
| 4,030,661 | 6/1977 | Farquhar | 229/52 BC X |

FOREIGN PATENT DOCUMENTS

| | | | |
|---|---|---|---|
| 648967 | 9/1962 | Canada | 229/52 B |
| 854573 | 10/1970 | Canada | 229/17 |
| 1464363 | 11/1966 | France . | |

*Primary Examiner*—Stephen Marcus
*Assistant Examiner*—Gary Elkins
*Attorney, Agent, or Firm*—Robert M. Krone; Joseph J. Kelly; Norvell E. Von Behren

[57] ABSTRACT

A four-ply handled carton for packaging a plurality of cans or bottles such as beer or soft drinks or the like is disclosed. The four-ply handle is formed by the use of three top handle panel sections used in conjunction with a fourth top handle panel section which is formed partially out of two of the top handle panel sections. The four-ply construction permits added strength to be incorporated into the top section of the carton in the vicinity of the normal handle openings used with a carton such as is disclosed in the subject application.

7 Claims, 4 Drawing Figures

18
10
22
20
26
2
2
14
16
106
24
12

18
28
30
40
34
36
38
32
16
14
12

108
50
32
34
98
102
30
112
114
110

FOUR-PLY HANDLED CARTON

BACKGROUND OF THE INVENTION

This application relates generally to folding cartons and more particularly to a four-ply handled carton for a plurality of cans or bottles of beverage.

It is known in the art of beverage carton design to provide cartons capable of handling 12 or more bottles or cans of beverage. Such large quantities of cans or bottles requires stronger folding cartons capable of handling the container weight without tearing in critical areas such as the handle by which the carton is conveyed. It is known to provide multiple thicknesses in the handle area of a folding carton as typified in the U.S. Pat. No. 3,933,303 issued to Thomas E. Kirby, Jr. on Jan. 20, 1976. Cartons such as the carton shown in the Kirby patent may utilize multiple thicknesses in the handle area ranging from two to four thicknesses as desired. For example, in the Kirby patent there is formed a triple thickness handle as shown in FIG. 2 of his patent which is produced by the use of three top handle panels shown in FIG. 6 of the drawing. In order to form a four-ply handle, there has been provided in the Kirby patent, as shown in FIG. 8 of the drawing, an additional fourth panel which is folded over the third and second panel to form the rolled up handle shown in FIGS. 9–11 of the drawing.

While such a four-ply handle construction appears to be satisfactory, the design shown in the subject patent requires an additional length of paperboard to form the fourth handle panel and requires a more complicated machine to set up the handle panel structure prior to the erection of the completed carton.

SUMMARY OF THE INVENTION

In order to overcome the problems inherent in the beforementioned four panel construction, there has been provided by the applicant's invention a four-ply handled carton which utilizes only three top handle panels with a fourth handle panel being formed partially out of two of the top handle panels. By the design thus incorporated, it is possible to obtain the effect of a four-ply handle without the addition of an extra handle panel thereby cutting the cost of the overall carton and the complexity of the machine required to set the carton up.

Accordingly, it is an object and object and advantage of the invention to provide a folding carton capable of handling a plurality of cans or bottles which has a four-ply handle construction in the top panel by the use of only three top handle panels.

Another object and advantage of the invention is to provide a folding carton for a plurality of cans or bottles having a four-ply handled construction without utilizing a fourth handle panel, thereby resulting in a less expensive carton than previously known.

These and other objects and advantages of the invention will become apparent from a review of the specification and from a study of the drawing detailing the preferred embodiment of the invention.

DESCRIPTION OF THE PREFERRED EMBODIMENT

Figure 1:
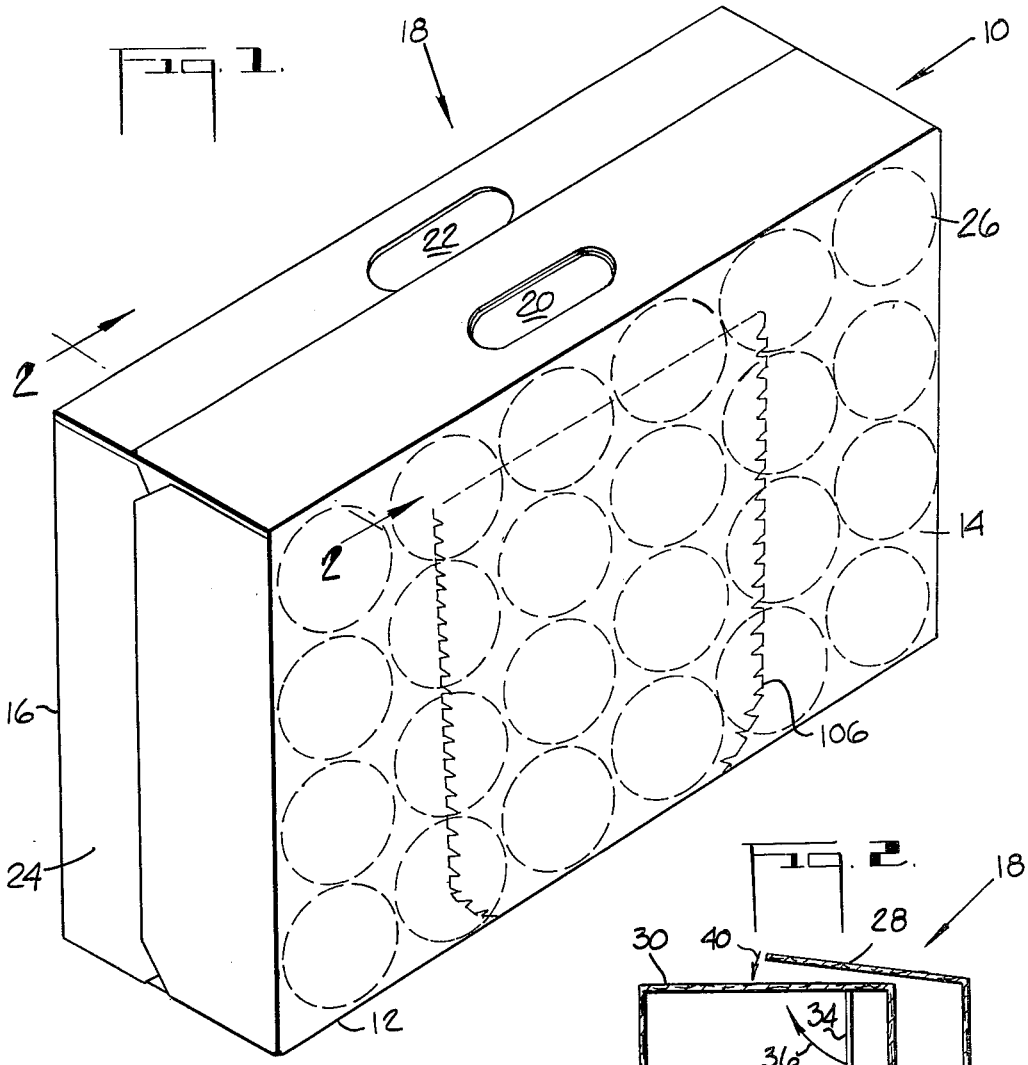
FIG. 1 is a perspective view of the applicant's four-ply handled carton showing the general type of carton detailed herein.

Referring now to the drawings in general and to FIG. 1 of the drawings in particular, there is shown the applicant's new and novel four-ply handled carton generally by the numeral 10 which comprises a bottom panel 12 hingedly attached to a pair of side panels 14 and 16. A top handle section 18 contains a pair of handle openings 20 and 22 through which the purchaser's fingers are inserted in order to carry the carton 10. Flap means 24 are formed on each end of the carton 10 to prevent the cans 26 from dropping out of the ends of the carton whenever the carton is carried by the purchaser.

Figure 2:
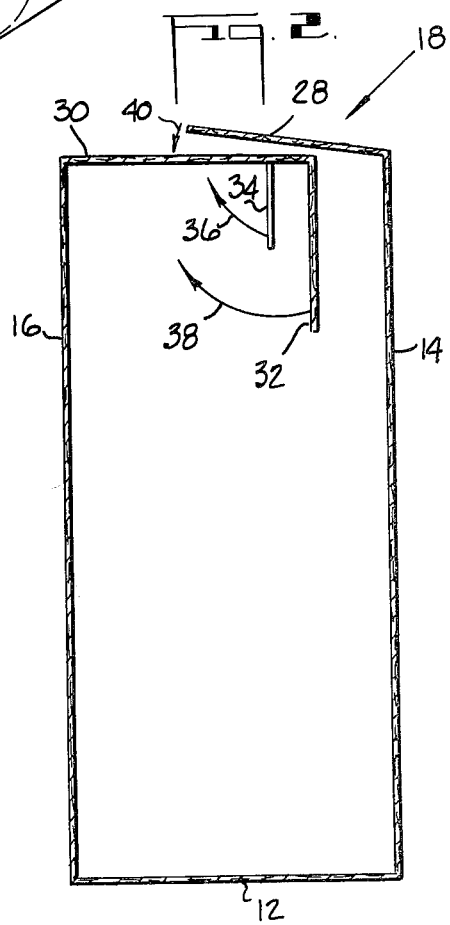
FIG. 2 is an end sectional view, taken along line 2—2 of FIG. 1 showing the folding sequence of the top handle panels in order to achieve a four-ply handle construction.

Referring now to FIG. 2 of the drawing, there is shown a side sectional view, taken along line 2—2 of FIG. 1 showing the relationship of the bottom panel 12 to the two side panels 14 and 16 and also showing in more detail the top handle section 18 of the applicant's invention. The top handle section 18 comrises a first top handle panel 28, a second top handle panel 30 and a third top handle panel 32, in addition, there is formed a fourth top handle panel 34 as will be described more fully hereinafter when referring to FIG. 3 of the drawing. In obtaining the four-ply handled construction, it can be seen in FIG. 2 that the fourth top handle 34 is folded inwardly in the direction shown by the arrow 36 after which the third top handle panel is folded inwardly as shown by the directional arrow 38 while the first top handle panel 28 is folded downwardly as shown by the directional arrow 40 to thereby obtain the four-ply construction in the vicinity of the handle openings 20 and 22 and along a greater portion of the longitudinal direction of the top handle section 18 in between the handle openings.

Figure 3:
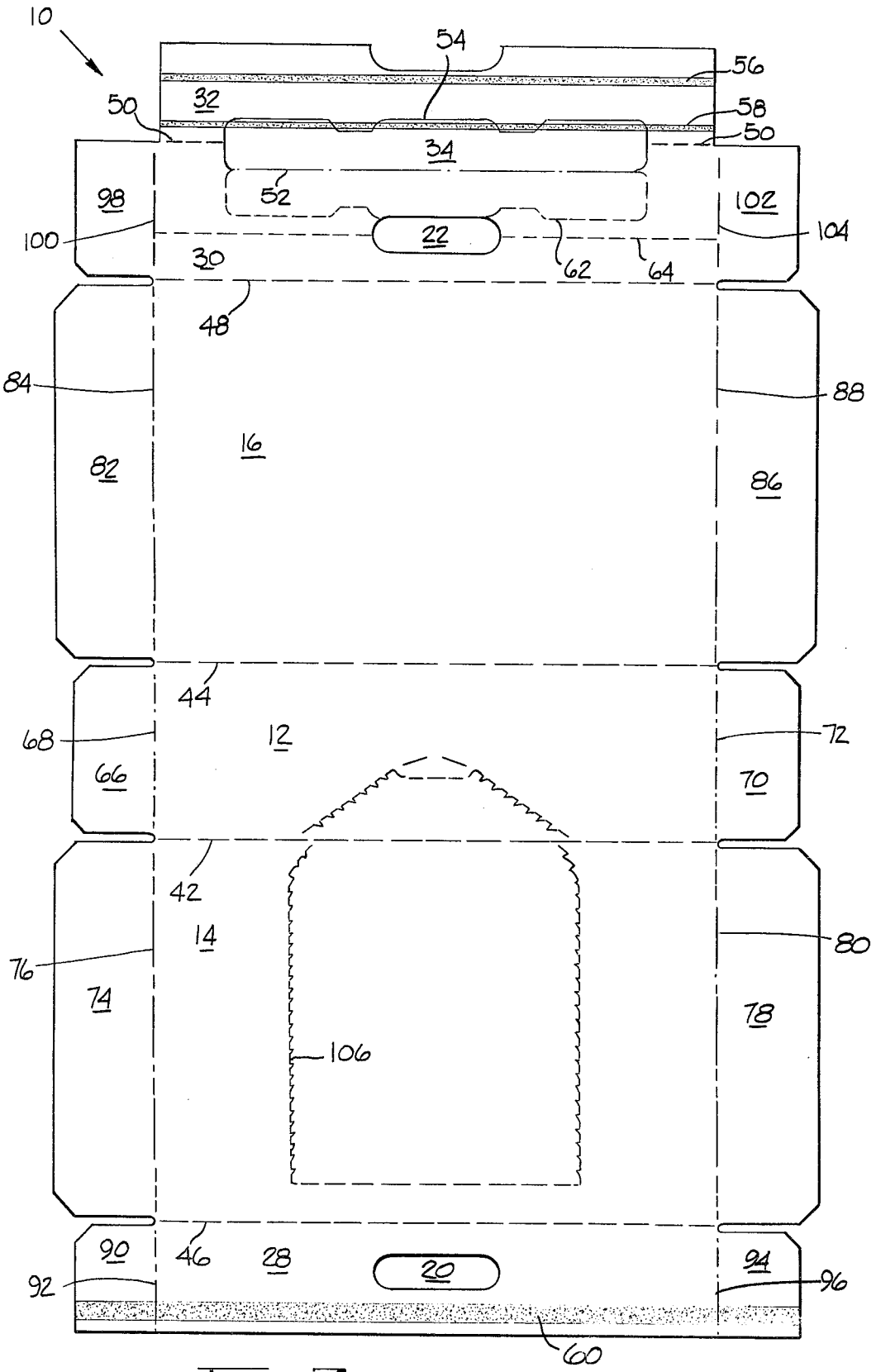
FIG. 3 is a plan view of the production blank used to form the applicant's four-ply handled carton.

By referring now to FIG. 3, there will be seen in more detail how the various panels are folded and glued and how each panel is hingedly attached to the respective next panel. A bottom panel 12 has hingedly attached on one side thereof a first side panel 14 by means of the score line 42 and also has hingedly attached on the other side thereof a second side panel 16 by means of the score line 44. The first side panel 14 has hingedly attached thereto a first top handle panel 28 by means of the score line 46 and the second side panel 16 has hingedly attached thereto a second top handle panel 30 by means of the score line 48.

The second top handle panel 30 also has hingedly attached thereto a third top handle panel 32 by means of the score line 50 and also has formed in the central portion thereof the handle opening 22 in a manner similar to the handle opening 20 formed in the central portion of the first top handle panel 28. A fourth top handle panel 34 is hingedly attached to the second top handle panel 30 by means of the score line 52 in the preferred embodiment shown in FIG. 3 of the drawing. The fourth top handle panel 34 is formed partly out of the second top handle panel 30 and partly out of the third top handle panel 32 and is partially severed from those handle panels by means of the irregularly shaped die cut line 54 which initiates at one end of the score line 52 and terminates at the other end of the score line 52. The third top handle panel 32 has a predetermined quantity of adhesive 56 and 58 applied in the areas shown by the stippling and in a similar manner the first top handle panel 28 has a predetermined quantity of adhesive 60 applied in the area shown by the stippling of FIG. 3.

It can then be seen that when the production blank is glued and set up that the fourth top handle panel 34 would be folded about the score line 52 to the position shown by the dotted line 62 and would be glued to the second top handle panel 30 by means of the adhesive 58. Thereafter, the third top handle panel 32 would be folded about the score line 50 and would be glued partially to the fourth top handle panel 34 by means of the adhesive 58 and would also be partially glued to the second top handle panel 30 by means of the adhesive 58 as well as the adhesive 56 and would assume the position shown by the dotted line 64. As has been mentioned when referring to FIG. 2 of the drawing, thereafter the completed carton would be glued together with the first top handle panel 28 being adhesively secured to the second top handle panel 30 by means of the adhesive 60 to thereby form in the vicinity of the handle openings 20 and 22 a four-ply construction which is formed by using only three top handle panels 28, 30 and 32 and by forming a partial top handle panel 34 partially out of the second top handle panel 30 and the third top handle panel 32.

The carton 10 of the subject invention is also formed having a flap means 24 which may be formed on some or all of the panels of the panels of the various sides and bottom of the carton. For example, in the preferred embodiment shown in FIG. 3 flap 66 is formed on one side of the bottom panel 12 by means of the score line 68 with a matching flap 70 formed on the other side by means of the score line 72. In a similar manner, the side panel 14 would have a flap 74 formed on one side thereof by means of the score line 76 and would have a flap 78 formed on the other side thereof by means of the score line 80. The side panel 16 similarly would have a flap 82 formed on one side thereof by means of the score line 84 and would have a similar flap 86 formed on the other side by means of the score line 88.

The first top handle panel 28 would have formed thereon a flap 90 on one side thereof by means of the score line 92 and would have formed on the other side thereof a flap 94 by means of the score line 96. In a similar manner, the second top handle panel 30 would have formed on one side thereof a flap 98 by means of the score line 100 and would have formed on the other side thereof a flap 102 by means of the score line 104. When formed thusly, the various end flaps would be adhesively secured together after the carton has been erected, opened and loaded with the cans or bottles contained within the carton. It may be desirous to have less number of flaps formed than shown in the preferred embodiment such as having only flaps formed on the first side panel and the second side panel and extending clear across the carton to be joined to the opposite side panels or to manufacture joint flaps formed on the side panels. A tear-out portion 106 may be formed in the side panel 14 as well as partially in the bottom panel 12 in order to remove the contents of the package without having to destroy the integrity of the package.

Figure 4:
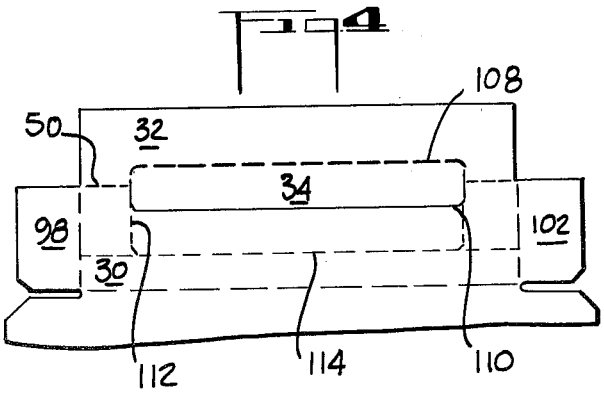
FIG. 4 is a partial plan view of one end of the production blank shown in FIG. 3 showing a modification of the fourth top handle panel used to form the applicant's four-ply handled carton.

Referring now to FIG. 4 of the drawing, there is shown a partial plan view of the upper end of the production blank shown in FIG. 3 showing a modification of the preferred embodiment wherein the fourth top handle panel 34 is hingedly attached to the third top handle panel 32 by means of the score line 108 and is partially cut from the second top handle panel 30 and the third top handle panel 32 by means of the die cut 110 which initiates at one end of the score line 108 and terminates at the other end of the same score line. When formed thusly, it can be seen how a four-ply handle construction will still be available using this embodiment wherein the fourth handle panel 34 would be first folded about the score line 108 to the position shown by the dotted line 112 after which the third top handle panel 32 would be folded about its score line 50 to the position shown by its dotted line 114 to complete a four-ply handled construction in the top section of the carton whenever the first top handle panel 28 is adhesively secured to complete the carton as has been beforementioned. In the FIG. 4 embodiment the adhesive is not shown but would be applied to the reverse side of panel 34 and to the facing side of panel 32. When used thusly, the embodiment shown in FIG. 4 may be used with a separate attached handle or may have finger openings cut in the various panels as is taught by the preferred embodiment shown in FIG. 1.

From the foregoing, it can be seen that there has been provided by the subject invention a new and novel four-ply handled carton for a plurality of cans or bottles which utilizes a four-ply handle construction in the top handle section of the carton without resorting to unnecessary extra handle panels and yet which achieves the same function as an extra handle would achieve. It should become apparent also that many changes may be made in the carton construction and in the arrangement of parts without departing from the spirit and scope of the invention and the invention is not limited to the exact construction shown which has been given by way of illustration only.

Having described my invention, I claim:

1. A four-ply handled carton for a plurality of cans or bottles, comprising:

(a) a bottom panel;

(b) a first side panel hingedly attached to one side of the bottom panel;

(c) a first top handle panel hingedly attached to the first side panel;

(d) a second side panel hingedly attached to the other side of the bottom panel;

(e) flap means, hingedly attached to at least one of the panels, for closing the ends of the carton;

(f) a second top handle panel hingedly attached to the second side panel;

(g) a third top handle panel hingedly attached to the second top handle panel;

(h) a fourth top handle panel formed partly out of the second top handle and partly out of the third top handle panel and hingedly attached to one of the handle panels;

(i) the fourth top handle panel being folded against and adhesively secured to the second top handle panel and the third top handle panel being folded against and adhesively secured partly to the fourth top handle panel and partly to the second top handle panel; and (j) the first top handle panel being adhesively secured to one of the top handle panels thereby forming a four-ply handle panel structure on the top of the carton.

2. The carton as defined in claim 1 further comprising the fourth top handle panel being hinged out of the second top handle panel.

3. The carton as defined in claim 1 further comprising the fourth top handle panel being hinged out of the third top handle panel.

4. The carton as defined in claim 1 further comprising the fourth top handle panel being hinged inwardly in the carton and the third top handle panel being hinged inwardly in the carton and further the first top handle panel is adhesively secured to the outside of the second top handle panel.

5. The carton as defined in claim 1 further comprising a full handle opening being formed in the first top handle panel and in the second top handle panel and further comprising a half handle opening being formed in the third top handle panel.

6. The carton as defined in claim 1 further comprising the flap means being formed on the first side panel and on the second side panel.

7. The carton as defined in claim 1 further comprising the flap means being formed on the first side panel and the second side panel as well as the bottom panel and the first and second top handle panels.

* * * * *